US010737501B2

(12) United States Patent
Sato et al.

(10) Patent No.: US 10,737,501 B2
(45) Date of Patent: Aug. 11, 2020

(54) LIQUID DISCHARGE APPARATUS AND DRIVING METHOD OF LIQUID DISCHARGE APPARATUS

(71) Applicant: SEIKO EPSON CORPORATION, Tokyo (JP)

(72) Inventors: Masahiko Sato, Matsumoto (JP); Hiroyuki Hagiwara, Matsumoto (JP); Daiki Tatsuta, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 55 days.

(21) Appl. No.: 15/866,298

(22) Filed: Jan. 9, 2018

(65) Prior Publication Data

US 2018/0215163 A1 Aug. 2, 2018

(30) Foreign Application Priority Data

Jan. 27, 2017 (JP) ..... 2017-012716

(51) Int. Cl.
*B41J 2/175* (2006.01)
*B41J 2/19* (2006.01)

(52) U.S. Cl.
CPC ..... *B41J 2/17563* (2013.01); *B41J 2/175* (2013.01); *B41J 2/17596* (2013.01); *B41J 2/19* (2013.01)

(58) Field of Classification Search
CPC . B41J 2/17563; B41J 2/175; B41J 2/19; B41J 2/17596
See application file for complete search history.

(56) References Cited

U.S. PATENT DOCUMENTS

| | | | | |
|---|---|---|---|---|
| 8,246,153 | B2 | 8/2012 | Miyajima | |
| 2010/0231667 | A1* | 9/2010 | Kanbe | B41J 2/17509 347/92 |
| 2014/0063141 | A1* | 3/2014 | Tsubaki | B41J 2/175 347/85 |
| 2015/0183225 | A1 | 7/2015 | Ishii et al. | |

FOREIGN PATENT DOCUMENTS

| | | |
|---|---|---|
| EP | 2347905 A2 | 7/2011 |
| JP | 2002-079684 | 3/2002 |
| JP | 2007-152884 | 6/2007 |
| JP | 2015-123688 | 7/2015 |
| WO | 2016-136333 | 9/2016 |

OTHER PUBLICATIONS

Translation of WO 2016/136333 A1. (Year: 2016).*
European Search Report issued in Application No. 18152733 dated May 3, 2018.

* cited by examiner

*Primary Examiner* — Justin Seo
(74) *Attorney, Agent, or Firm* — Workman Nydegger

(57) ABSTRACT

A liquid discharge apparatus includes a filter chamber that is provided in a flow path that supplies liquid to a liquid discharge unit, a filter that partitions the filter chamber into an upstream side chamber to which the liquid is supplied and a downstream side chamber that communicates with the liquid discharge unit, a storage chamber that is arranged vertically above the filter chamber and is connected to a branch of the flow path on the upstream side of the upstream side chamber of the filter chamber, and a pump that supplies the liquid to the flow path.

19 Claims, 6 Drawing Sheets

LIQUID DISCHARGE APPARATUS AND DRIVING METHOD OF LIQUID DISCHARGE APPARATUS

BACKGROUND

1. Technical Field

The present invention relates to a technique for discharging liquid such as ink.

2. Related Art

A liquid discharge apparatus that discharges liquid such as ink from nozzles is provided with a filter chamber, in which a filter that removes bubbles and foreign objects mixed into liquid is arranged, is provided in the middle of a liquid flow path through which the liquid flows. The filter is provided so as to partition the filter chamber into an upstream side chamber and a downstream side chamber, so that if bubbles remain in the upstream side chamber, the filter chamber is difficult to be filled with liquid. Therefore, for example, in JP-A-2015-123688, a protrusion portion is provided in a region facing the upstream side chamber of the filter chamber and thereby a liquid flow that bypasses the protrusion portion is generated in the upstream side chamber. Thereby, in the upstream side chamber, the remaining bubbles move with the liquid flow, so that the bubbles in the upstream side chamber easily pass through the filter and move to the downstream side chamber. Thereby, the filter chamber is easily filled with liquid.

SUMMARY

However, for example, when the entire surface of the filter is wet and menisci are formed in holes of the filter, it is difficult for bubbles to pass through the filter. In this case, even when the bubbles are easily moved by a flow that bypasses the protrusion portion in the upstream side chamber of the filter chamber as in JP-A-2015-123688, the bubbles are hardly discharged to the downstream side chamber, so that the filling property of liquid is lowered. Further, while the filter chamber is being filled with liquid, if the liquid in the upstream side chamber partially passes through the filter and flows out to the downstream side chamber, the upstream side chamber of the filter chamber is hardly filled with the liquid. Therefore, it takes time for the filter chamber to be filled with the liquid, and the filling property is lowered. An advantage of some aspects of the invention is to improve the filling property of liquid into the filter chamber.

Mode 1

To solve the above problems, a liquid discharge apparatus according to a preferred mode (mode 1) of the invention includes a filter chamber that is provided in a flow path that supplies liquid to a liquid discharge unit, a filter that partitions the filter chamber into an upstream side chamber to which the liquid is supplied and a downstream side chamber that communicates with the liquid discharge unit, a storage chamber that is arranged vertically above the filter chamber and is connected to a branch of the flow path on the upstream side of the upstream side chamber of the filter chamber, and a pump that supplies the liquid to the flow path. According to the above mode, the liquid supplied to the flow path by the pump is supplied to the upstream side chamber of the filter chamber and is also supplied to the storage chamber and stored. The storage chamber is arranged vertically above the filter chamber, so that a head difference occurs between a liquid level of the liquid supplied to the upstream side chamber of the filter chamber and a liquid level of the liquid supplied to the storage chamber. Therefore, when the liquid supply by the pump is stopped, the liquid stored in the storage chamber is flowed into the upstream side chamber of the filter chamber by the head difference. In this way, according to the present mode, it is possible to promptly fill the upstream side chamber of the filter chamber with liquid by using the head difference between the liquid level of the upstream side chamber of the filter chamber and the liquid level of the storage chamber, so that it is possible to improve the filling property of liquid into the filter chamber.

Mode 2

In a preferred mode (mode 2) of the invention, the flow path includes a supply flow path to which the upstream side chamber of the filter chamber is connected, the storage chamber that is connected to a branch of the supply flow path on the upstream side of the filter chamber and also is connected to the upstream side chamber of the filter chamber, and a first connection portion that connects the upstream side chamber of the filter chamber and the supply flow path and a second connection portion that connects the upstream side chamber of the filter chamber and the storage chamber are connected to the upstream side chamber of the filter chamber at different positions from each other. According to the above mode, the liquid supplied to the supply flow path by the pump is supplied from the first connection portion to the upstream side chamber of the filter chamber and is also supplied to and stored in the storage chamber that is connected to a branch of the supply flow path. The storage chamber is arranged vertically above the filter chamber. Therefore, when the liquid supply by the pump is stopped, the liquid stored in the storage chamber is passed through the supply flow path and flowed into the upstream side chamber of the filter chamber through the first connection portion by the head difference between the liquid level of the upstream side chamber of the filter chamber and the liquid level of the storage chamber. At this time, gas in the upstream side chamber of the filter chamber is discharged to the storage chamber through the second connection portion whose position is different from that of the first connection portion, so that the liquid stored in the storage chamber easily flows into the upstream side chamber of the filter chamber through the first connection portion. In other words, when seen from the storage chamber, while the liquid is discharged from the storage chamber to the upstream side chamber of the filter chamber through the first connection portion, the gas in the upstream side chamber of the filter chamber is introduced from the second connection portion to the storage chamber. Therefore, the liquid in the storage chamber easily flows to the upstream side chamber of the filter chamber, and the gas in the upstream side chamber of the filter chamber is easily discharged to the storage chamber. Thus, even when the air in the upstream side chamber of the filter chamber is not sucked from the downstream side chamber and accordingly is not discharged through the filter in a state in which, for example, a valve (for example, a choke valve) provided on the upstream side of the filter chamber is closed, it is possible to improve the filling property of liquid.

Mode 3

A preferred example (mode 3) of the mode 2 includes a gas discharge portion that is provided in the storage chamber. According to the above mode, the gas discharge portion provided in the storage chamber is included, so that the gas (bubbles) in the storage chamber can be discharged to the outside by the gas discharge portion.

Mode 4

In a preferred example (mode 4) of the mode 3, a flow path resistance from the upstream side chamber of the filter chamber to the storage chamber through the second connection portion is greater than a flow path resistance from the upstream side chamber of the filter chamber to the storage chamber through the first connection portion. According to the above mode, the flow path resistance from the upstream side chamber of the filter chamber to the storage chamber through the second connection portion is greater than the flow path resistance from the upstream side chamber of the filter chamber to the storage chamber through the first connection portion, so that it is possible to prevent the gas accumulated in the storage chamber from back flowing to the upstream side chamber of the filter chamber through the second connection portion. Therefore, even when a flow speed of the liquid supplied from the upstream side chamber of the filter chamber to the liquid discharge unit increases, the liquid supplied though the first connection portion is easily drawn to the upstream side chamber of the filter chamber, so that it is possible to cause the gas accumulated in the storage chamber to be difficult to be drawn to the upstream side chamber of the filter chamber through the second connection portion.

Mode 5

In a preferred example (mode 5) of the mode 3 or the mode 4, the gas discharge portion is provided in a ceiling surface of the storage chamber, and a portion where the gas discharge portion is provided in the ceiling surface of the storage chamber is located above a position, where the storage chamber is connected to the supply flow path, in a vertical direction. According to the above mode, the gas discharge portion is provided in the ceiling surface of the storage chamber, so that the gas in the storage chamber can be easily moved to the gas discharge portion by buoyancy. Further, the portion where the gas discharge portion is provided in the ceiling surface of the storage chamber is located above a position, where the storage chamber is connected to the supply flow path, in the vertical direction, so that gas floated to the ceiling surface of the storage chamber is easily moved from the supply flow path to the gas discharge portion. Therefore, it is possible to prevent the gas in the storage chamber from back flowing to the supply flow path.

Mode 6

In a preferred example (mode 6) of any one of the modes 2 to 5, the second connection portion is provided in a ceiling surface of the upstream side chamber of the filter chamber, and the ceiling surface inclines upward in a vertical direction as the ceiling surface approaches the second connection portion. According to the above mode, the gas (bubbles) in the upstream side chamber of the filter chamber can be easily moved to the second connection portion by buoyancy, so that it is possible to easily move the gas in the upstream side chamber to the storage chamber through the second connection portion.

Mode 7

In a preferred example (mode 7) of any one of the modes 2 to 6, a flow path resistance from the supply flow path to the upstream side chamber of the filter chamber through the storage chamber and the second connection portion is smaller than a flow path resistance from the supply flow path to the upstream side chamber of the filter chamber through the first connection portion. According to the above mode, liquid supplied to the supply flow path is more easily supplied to the storage chamber than to the upstream side chamber of the filter chamber. Therefore, it is possible to efficiently store the liquid from the supply flow path into the storage chamber.

Mode 8

In a preferred example (mode 8) of any one of the modes 2 to 7, a bottom surface of the storage chamber inclines downward in a vertical direction as the bottom surface approaches a position where the storage chamber is connected to the supply flow path. According to the above mode, the liquid in the storage chamber can be easily moved to the supply flow path by the force of gravity. Therefore, it is possible to efficiently move the liquid in the storage chamber to the upstream side chamber of the filter chamber through the supply flow path.

Mode 9

In a preferred example (mode 9) of any one of the modes 1 to 8, a volume of the storage chamber is greater than or equal to a volume of the upstream side chamber of the filter chamber. According to the above mode, the volume of the storage chamber is greater than or equal to the volume of the upstream side chamber of the filter chamber, so that when the liquid stored in such a storage chamber is moved to the upstream side chamber of the filter chamber, the upstream side chamber of the filter chamber can be fully filled with the liquid. Therefore, the liquid can be efficiently filled.

Mode 10

In a preferred example (mode 10) of any one of the modes 1 to 9, the pump is controlled by a plurality of steps, and the plurality of steps includes a first step of driving the pump and supplying the liquid to the upstream side chamber of the filter chamber and the storage chamber through the flow path so that a head difference occurs between a liquid level of the liquid in the upstream side chamber of the filter chamber and a liquid level of the liquid in the storage chamber, and a second step of stopping the pump and causing the upstream side chamber of the filter chamber to be filled with the liquid stored in the storage chamber through the flow path by the head difference. According to the above mode, by only switching the pump from drive to stop, it is possible to efficiently fill the upstream side chamber of the filter chamber with the liquid from the storage chamber. Therefore, it is possible to simplify the control to fill the filter chamber 31 with the liquid.

Mode 11

A method according to a preferred mode (mode 11) of the invention is a driving method of a liquid discharge apparatus. The liquid discharge apparatus includes a filter chamber that is provided in a flow path that supplies liquid to a liquid discharge unit, a filter that partitions the filter chamber into an upstream side chamber to which the liquid is supplied and a downstream side chamber that communicates with the liquid discharge unit, a storage chamber that is arranged vertically above the filter chamber and is connected to a branch of the flow path on the upstream side of the upstream side chamber of the filter chamber, and a pump that supplies the liquid to the flow path. The driving method includes a first step of driving the pump and supplying the liquid to the upstream side chamber of the filter chamber and the storage chamber through the flow path so that a head difference occurs between a liquid level of the liquid in the upstream side chamber of the filter chamber and a liquid level of the liquid in the storage chamber, and a second step of stopping the pump and causing the upstream side chamber of the filter chamber to be filled with the liquid stored in the storage chamber through the flow path by the head difference. According to the above mode, by only switching the pump, which supplies the liquid, from drive by the first step to stop by the second step, it is possible to efficiently fill the upstream side chamber of the filter chamber with the liquid from the storage chamber. In this way, according to the present mode, it is possible to promptly fill the upstream side chamber of the filter chamber with liquid by using the head difference between the upstream side chamber of the filter chamber and the storage chamber, so that it is possible to improve the filling property of liquid into the filter chamber. Further, it is possible to simplify the control to fill the filter chamber with liquid.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
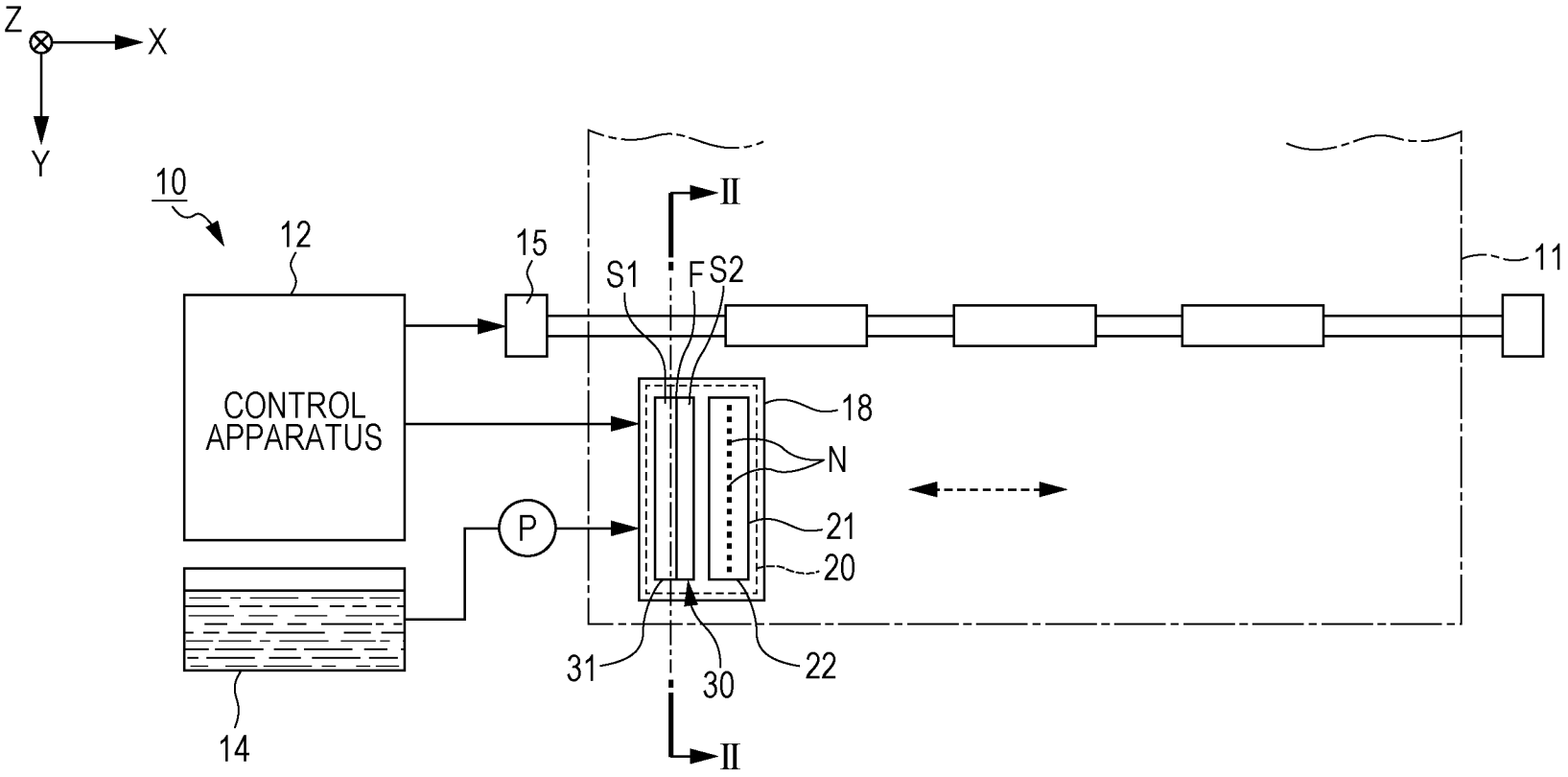
FIG. 1 is a configuration diagram of a liquid discharge apparatus according to an embodiment of the present invention.

FIG. 1 is a partial configuration diagram of a liquid discharge apparatus 10 according to an embodiment of the invention. The liquid discharge apparatus 10 of the embodiment is an ink jet type printing apparatus that discharges ink, which is an example of liquid, to a medium 11. The liquid discharge apparatus 10 shown in FIG. 1 includes a control apparatus 12, a transport mechanism 15, a liquid discharge head 20, and a carriage 18. The liquid discharge apparatus 10 is attached with a liquid container (cartridge) 14 that stores ink.

The liquid container 14 is an ink tank type cartridge consisting of a box-shaped container that can be attached to and detached from a main body of the liquid discharge apparatus 10. The liquid container 14 is not limited to a box-shaped container but may be an ink pack type cartridge consisting of a bag-shaped container. The liquid container 14 stores ink. The ink may be black ink or may be color ink. The ink stored in the liquid container 14 is supplied (forcibly transferred) to the liquid discharge head 20 by a pump P.

The control apparatus 12 integrally controls each component of the liquid discharge apparatus 10. The transport mechanism 15 transports the medium 11 in a Y direction under control of the control apparatus 12. The liquid discharge head 20 discharges ink from each of a plurality of nozzles N under control of the control apparatus 12. The liquid discharge head 20 includes a liquid discharge unit 22 and a filter unit 30.

A nozzle array is arranged in the liquid discharge head 20. The nozzle array is a set of a plurality of nozzles N arranged linearly along the Y direction. The plurality of nozzles N are formed on a discharge surface 21 which is on the liquid discharge unit 22 and faces the medium 11. The number of the liquid discharge units 22 and the number of the nozzle arrays are not limited to those shown in the drawings. The liquid discharge unit 22 includes a plurality of pairs of a pressure chamber and a piezoelectric element (not shown in the drawings) corresponding to different nozzles N. Ink filled in the pressure chamber is discharged from each nozzle N when changing pressure inside the pressure chamber by supplying a drive signal to vibrate the piezoelectric elements.

The liquid discharge head 20 is mounted on the carriage 18. The control apparatus 12 reciprocates the carriage 18 in an X direction crossing the Y direction. The liquid discharge head 20 discharges ink to the medium 11 while the transport mechanism 15 transfers the medium 11 and the carriage 18 repeatedly reciprocates, so that a desired image is formed on a surface of the medium 11. For example, a plurality of liquid discharge heads 20 that discharge inks of different types can be mounted on the carriage 18. A direction (a vertical direction) perpendicular to an X-Y plane (a plane parallel to the surface of the medium 11) is referred to as Z direction.

The filter unit 30 functions as a filter apparatus arranged with a filer F that collects bubbles and foreign objects mixed into ink in a flow path. The filter unit 30 is provided in a flow path of ink supplied from the liquid container 14. The filter unit 30 includes a filter chamber 31 that communicates with the flow path of ink. The filter F is arranged in the filter chamber 31 so as to partition the filter chamber 31 into an upstream side chamber S1 and a downstream side chamber S2. The filter unit 30 of the embodiment is a vertical installation type, and is arranged so as to stand up in a direction (Z direction) crossing the discharge surface 21 of the liquid discharge unit 22. The ink supplied from the liquid container 14 passes through the filter F of the filter unit 30 and is supplied to the liquid discharge unit 22.

Figure 2:
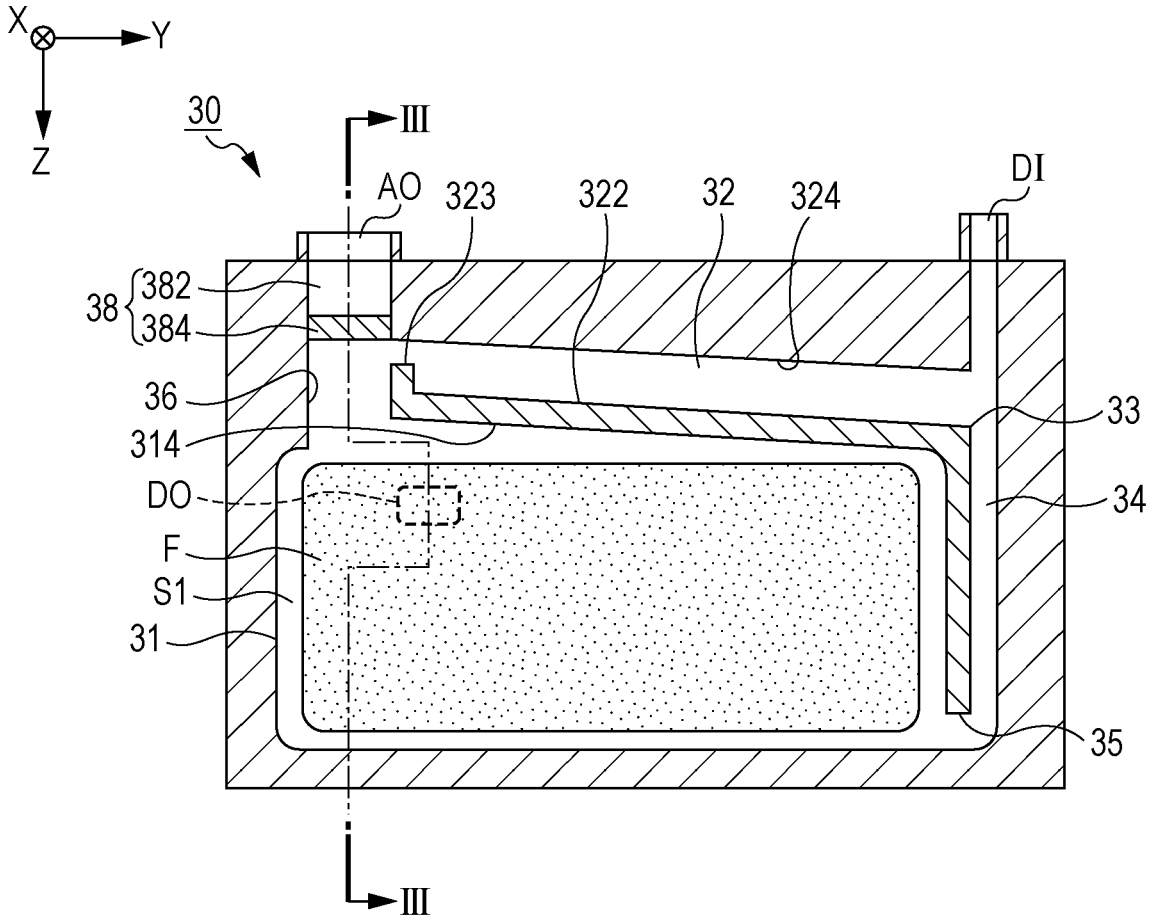
FIG. 2 is a cross-sectional view of a filter unit shown in FIG. 1 taken along line II-II.
Figure 3:
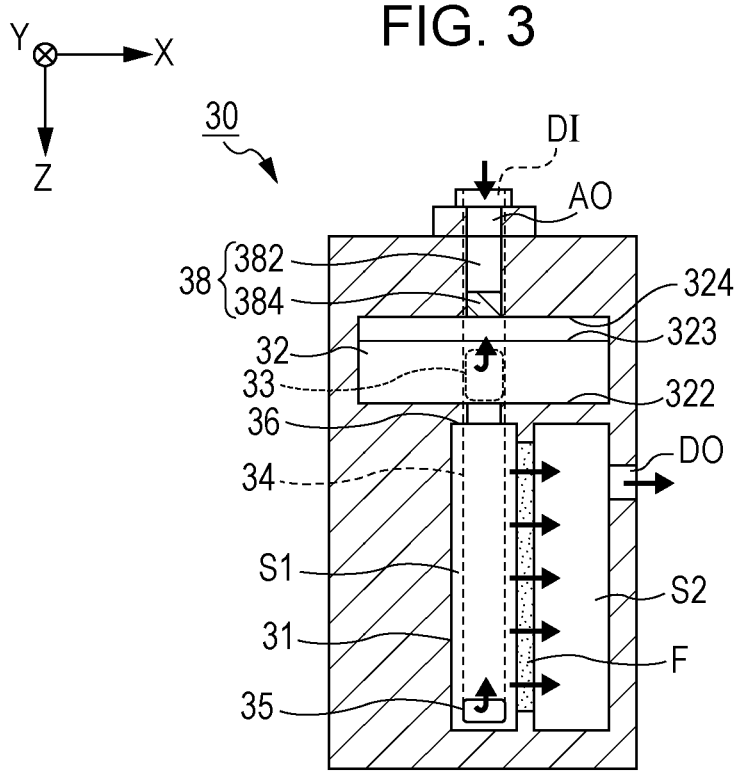
FIG. 3 is a cross-sectional view of a filter unit shown in FIG. 2 taken along line III-III.

A specific configuration of the filter unit 30 according to the embodiment will be described. FIGS. 2 and 3 are diagrams showing a configuration of the filter unit 30 according to the embodiment. FIG. 2 is a cross-sectional view of the filter unit 30 shown in FIG. 1 taken along line II-II. FIG. 2 is a cross-sectional view where the upstream side chamber S1 is cut by a cross section along a Y-Z plane and seen from the X direction. FIG. 3 is a cross-sectional view of the filter unit 30 shown in FIG. 2 taken along line III-III. FIG. 3 is a cross-sectional view where the filter unit 30 is cut by a cross section along an X-Z plane and seen from the Y direction.

As shown in FIGS. 2 and 3, the filter unit 30 includes an inflow port DI, an outflow port DO, the filter chamber 31, a storage chamber 32, the filter F, and a supply flow path 34. The filter chamber 31 is partitioned by the filter F into the upstream side chamber S1 and the downstream side chamber S2. The upstream side chamber S1 is a space on the upstream side of the filter F. The ink from the liquid container 14 is supplied to the upstream side chamber S1 through the inflow port DI. The downstream side chamber S2 is a space on the downstream side of the filter F. The downstream side chamber S2 communicates with the liquid discharge unit 22 through the outflow port DO. As shown by solid line arrows in FIG. 3, the ink from the liquid container 14 is supplied to the upstream side chamber S1 from the inflow port DI, moved to the downstream side chamber S2 passing through the filter F, discharged from the outflow port DO, and supplied to the liquid discharge unit 22.

The filter chamber 31 and the filter F are arranged so as to extend in the vertical direction (Z direction) and the storage chamber 32 is arranged vertically above the filter chamber 31. The supply flow path 34 is a flow path connected to both the storage chamber 32 and the upstream side chamber S1 of the filter chamber 31. The supply flow path 34 forms a part of a flow path from the liquid container 14 to the liquid discharge unit 22. The storage chamber 32 is a space that temporarily stores ink to be flowed into the upstream side chamber S1 of the filter chamber 31. The storage chamber 32 is arranged vertically above the filter chamber 31 and is connected to a branch of the supply flow path 34 on the upstream side of the upstream side chamber S1 of the filter chamber 31.

A first connection portion 35 that connects the upstream side chamber S1 of the filter chamber 31 and the supply flow path 34 and a second connection portion 36 that connects the upstream side chamber S1 of the filter chamber 31 and the storage chamber 32 are connected to the upstream side chamber S1 of the filter chamber 31 at different positions. The first connection portion 35 is located below the filter chamber 31 in the vertical direction and the second connection portion 36 is located above the filter chamber 31 in the vertical direction. Specifically, the first connection portion 35 is a communication port formed in a side surface (side surface on the positive side of Y direction) 312 of the upstream side chamber S1 at a vertically lower portion of the upstream side chamber S1. On the other hand, the second connection portion 36 is a communication port formed in a ceiling surface 314 of the upstream side chamber S1 at a vertically upper portion of the filter chamber 31. In this way, the first connection portion 35 is located lower than the second connection portion 36 in the vertical direction.

A flow path resistance from the supply flow path 34 to the upstream side chamber S1 of the filter chamber 31 through the storage chamber 32 and the second connection portion 36 may be smaller than a flow path resistance from the supply flow path 34 to the upstream side chamber S1 of the filter chamber 31 through the first connection portion 35. By doing so, ink supplied to the supply flow path 34 is more easily supplied to the storage chamber 32 than to the upstream side chamber S1 of the filter chamber 31. Therefore, it is possible to efficiently store the ink from the supply flow path 34 into the storage chamber 32.

According to the embodiment of such a configuration, ink is supplied (forcibly transferred) from the inflow port DI to the supply flow path 34 by driving the pump P, so that the ink is supplied to both the storage chamber 32 and the filter chamber 31 and a head difference between a liquid level of the storage chamber 32 and a liquid level of the upstream side chamber S1 of the filter chamber 31 is formed. Therefore, when the supply of the ink by the pump P is stopped, it is possible to promptly move the ink in the storage chamber 32 to the upstream side chamber S1 of the filter chamber 31 through the supply flow path 34 by the head difference described above. In this way, it is possible to promptly fill the filter chamber 31 with ink by using the head difference between the liquid level of the upstream side chamber S1 of the filter chamber 31 and the liquid level of the storage chamber 32, so that it is possible to improve a filling property of ink into the filter chamber 31.

Figure 4:
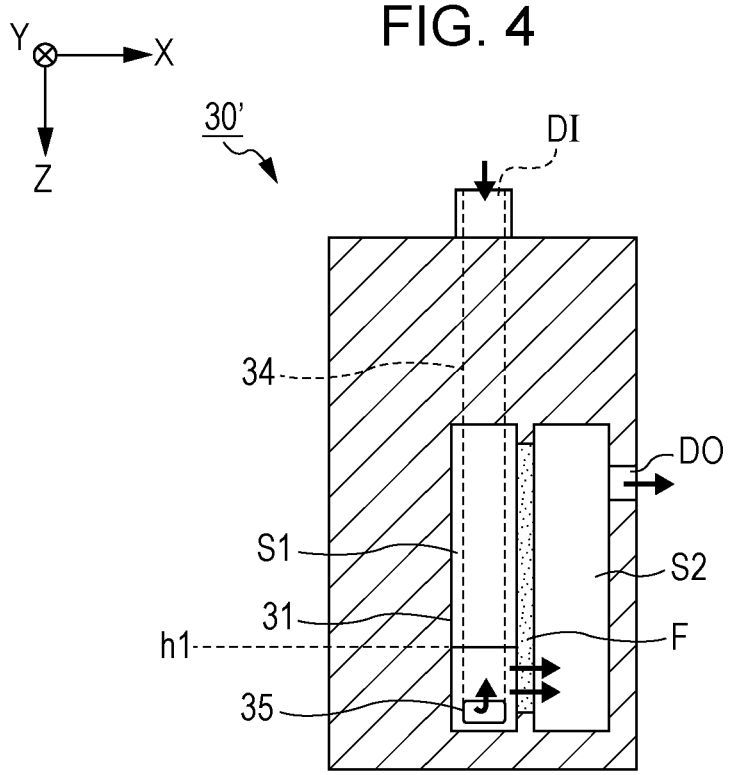
FIG. 4 is a cross-sectional view of a filter unit according to a comparative example.

If the storage chamber 32 is not provided, there is a risk that it takes time to fill the upstream side chamber S1 of the filter chamber 31 with ink. FIG. 4 is a cross-sectional view showing a configuration of a filter unit 30' according to a comparative example in which the storage chamber 32 is not provided. FIG. 4 shows a cross section corresponding to the cross section in FIG. 3. In a configuration in which the storage chamber 32 is not provided, for example, if there is gas (bubbles) in the filter chamber 31 during initial filling, it is difficult to fill with ink and it takes time to fill with ink. Therefore, for example, in a state in which the inflow port DI of the filter chamber 31 is closed by a choke valve or the like, the downstream side chamber S2 is sucked from the nozzles N. Thereby, gas in the upstream side chamber S1 is discharged through the filter F, so that it is possible to improve the filling property of ink.

However, if the entire surface of the filter F is wet and menisci are formed in holes of the filter F, it is difficult for gas to pass through the filter F. In this case, the gas in the upstream side chamber S1 of the filter chamber 31 is difficult to be discharged and the filling property of ink is lowered. Further, as shown in FIG. 4, when the gas in the upstream side chamber S1 is not discharged, even if ink is filled in the upstream side chamber S1, the ink in the upstream side chamber S1 partially passes through the filter F and flows out to the downstream side chamber S2. Under such circumstances, even when ink is supplied, a liquid level h1 of the upstream side chamber S1 does not rise and ink is hardly filled. Therefore, it takes time for the filter chamber 31 to be filled with ink, so that the filling property is lowered.

On the other hand, in the embodiment, by only switching the pump P from drive to stop, it is possible to supply the ink stored in the storage chamber 32 to the upstream side chamber S1 of the filter chamber 31 through the supply flow path 34 by the head difference between the liquid level of the upstream side chamber S1 of the filter chamber 31 and the liquid level of the storage chamber 32. At this time, the gas in the filer chamber 31 is discharged to the storage chamber 32 through the second connection portion 36, so that the ink stored in the storage chamber 32 easily flows into the upstream side chamber S1 of the filter chamber 31 through the first connection portion 35. Therefore, even when the air in the upstream side chamber S1 is not sucked from the downstream side chamber S2 and accordingly is not discharged through the filter F, it is possible to improve the filling property of ink.

The ceiling surface 314 of the upstream side chamber S1 of the filter chamber 31 of the embodiment inclines upward in the vertical direction as it approaches the second connection portion 36. According to this configuration, the gas (bubbles) in the upstream side chamber S1 can be easily moved to the second connection portion 36 by buoyancy, so that it is possible to easily move the gas in the upstream side chamber S1 to the storage chamber 32 through the second connection portion 36. The volume of the storage chamber 32 is preferred to be greater than or equal to the volume of the upstream side chamber S1 of the filter chamber 31. When the ink stored in such a storage chamber 32 is moved to the upstream side chamber S1 of the filter chamber 31, the upstream side chamber S1 of the filter chamber 31 can be fully (100%) filled with the ink. Therefore, the ink can be efficiently filled.

As shown in FIG. 2, on a bottom surface 322 of the storage chamber 32, a bank portion (protrusion portion) 323 that rises upward from the bottom surface 322 is formed. As shown in FIG. 2, the bank portion 323 is away from a position 33 where the storage chamber 32 is connected to the supply flow path 34 in the Y direction and is arranged close to the second connection portion 36. As shown in FIG. 3, the bank portion 323 continues from the negative side to the positive side in the X direction. Thereby, the ink supplied to the storage chamber 32 can be stored up to the height of the bank portion 323, and even if the ink in the storage chamber 32 exceeds the height of the bank portion 323, the ink is supplied to the upstream side chamber S1 of the filter chamber 31 through the second connection portion 36.

The bank portion 323 is formed in this way, so that the ink in the storage chamber 32 does not flow out from the second connection portion 36 and can be stored in the storage chamber 32 until the ink exceeds the height of the bank portion 323. Therefore, the ink can be easily stored in the storage chamber 32. Further, by forming the bank portion 323, it becomes easy to form the head difference between the liquid level of the storage chamber 32 and the liquid level of the upstream side chamber S1 of the filter chamber 31. Therefore, when the supply of ink by the pump P is stopped, it is possible to promptly move the ink in the storage chamber 32 to the upstream side chamber S1 of the filter chamber 31 through the supply flow path 34 by the head difference described above.

The bottom surface 322 of the storage chamber 32 inclines downward in the vertical direction as it approaches from the negative side to the positive side in the Y direction, that is, as it approaches from the second connection portion 36 to the position 33 where the storage chamber 32 is connected. According to this configuration, when the supply of ink by the pump P is stopped, the ink in the storage chamber 32 can be easily moved to the supply flow path 34 by the force of gravity. Therefore, it is possible to efficiently move the ink in the storage chamber 32 to the upstream side chamber S1 of the filter chamber 31 through the supply flow path 34.

As shown in FIG. 2, a gas discharge portion 38 is provided in the ceiling surface 324 of the storage chamber 32. A portion where the gas discharge portion 38 is provided in the ceiling surface 324 of the storage chamber 32 is located above the position 33, where the storage chamber 32 is connected to the supply flow path 34, in the vertical direction. The gas discharge portion 38 includes a gas permeable membrane 384 that forms a part of the ceiling surface 324 and a defoaming chamber 382 that communicates with the storage chamber 32 through the permeable membrane 384. The gas permeable membrane 384 is a gas permeable film (a gas-liquid separation membrane) that transmits gas (air) but does not transmit liquid such as ink, and is formed of, for example, a known polymer material. The gas permeable membrane 384 is arranged a position above the second connection portion 36, that is, a position on the negative side in the Z direction.

The defoaming chamber 382 is communicated with a gas discharge port AO. The defoaming chamber 382 is a space where deforming is performed in which gas (bubbles) remaining in the storage chamber 32 and the upstream side chamber S1 of the filter chamber 31 is discharged through the gas permeable membrane 384 by depressurizing the defoaming chamber 382. Instead of providing a known polymer material as the gas permeable membrane 384, a thin portion that is thinner than other portions may be provided to a part of a wall portion that forms the ceiling surface 324 of the storage chamber 32. Thereby, the thin portion can be functioned as the gas permeable membrane 384. Although not shown in the drawings, the gas discharge portion 38 may include a flow path that communicates the defoaming chamber 382 to a waste liquid tank (a waste liquid container) through the gas discharge port AO and a depressurizing pump provided in a flow path from the gas discharge port AO to the waste liquid tank. By depressurizing the defoaming chamber 382 by the depressurizing pump to cause the gas remaining in the storage chamber 32 and the upstream side chamber S1 of the filter chamber 31 to easily pass through the permeable membrane 384, it is possible to discharge the gas from the defoaming chamber 382 to the waste liquid tank. Further, the gas remaining in the storage chamber 32 and the upstream side chamber S1 of the filter chamber 31 may be discharged by communicating the waste liquid tank with the gas discharge portion 38 not through the permeable membrane 384.

By providing the gas discharge portion 38 to the storage chamber 32 in this way, it is possible to cause the gas (bubbles) remaining in the storage chamber 32 and the upstream side chamber S1 of the filter chamber 31 to pass through the permeable membrane 384 of the gas discharge portion 38 to be outputted to the outside from the gas discharge port AO. Further, by providing the gas discharge portion 38 in the ceiling surface 324 of the storage chamber 32, the gas (bubbles) in the storage chamber 32 can be easily moved to the gas discharge portion 38 by buoyancy. Further, the gas discharge portion 38 is located above the position 33, where the storage chamber 32 is connected to the supply flow path 34, in the vertical direction, so that gas floated to the ceiling surface 324 of the storage chamber 32 is easily moved from the supply flow path 34 to the gas discharge portion 38. Therefore, it is possible to prevent the gas in the storage chamber 32 from back flowing to the supply flow path 34.

Further, in the embodiment, a flow path resistance from the upstream side chamber S1 of the filter chamber 31 to the storage chamber 32 through the second connection portion 36 is greater than a flow path resistance from the upstream side chamber S1 of the filter chamber 31 to the storage chamber 32 through the first connection portion 35. According to this configuration, it is possible to prevent the gas accumulated in the storage chamber 32 from back flowing to the upstream side chamber S1 of the filter chamber 31 through the second connection portion 36. Therefore, even when a flow speed of the ink supplied from the filter chamber 31 to the liquid discharge unit 22 increases, the ink supplied though the first connection portion 35 is easily drawn to the upstream side chamber S1 of the filter chamber 31, so that it is possible to cause the gas accumulated in the storage chamber 32 to be difficult to be drawn to the upstream side chamber S1 of the filter chamber 31 through the second connection portion 36.

Hereinafter, a driving method of the liquid discharge apparatus 10 according to the embodiment will be described. Specifically, an operation of filling the filter chamber 31 of the filter unit 30 with ink will be described by dividing the operation into an operation during ink initial filling, an operation during printing, and an operation during defoaming.

During Ink Initial Filling

Figure 5A:
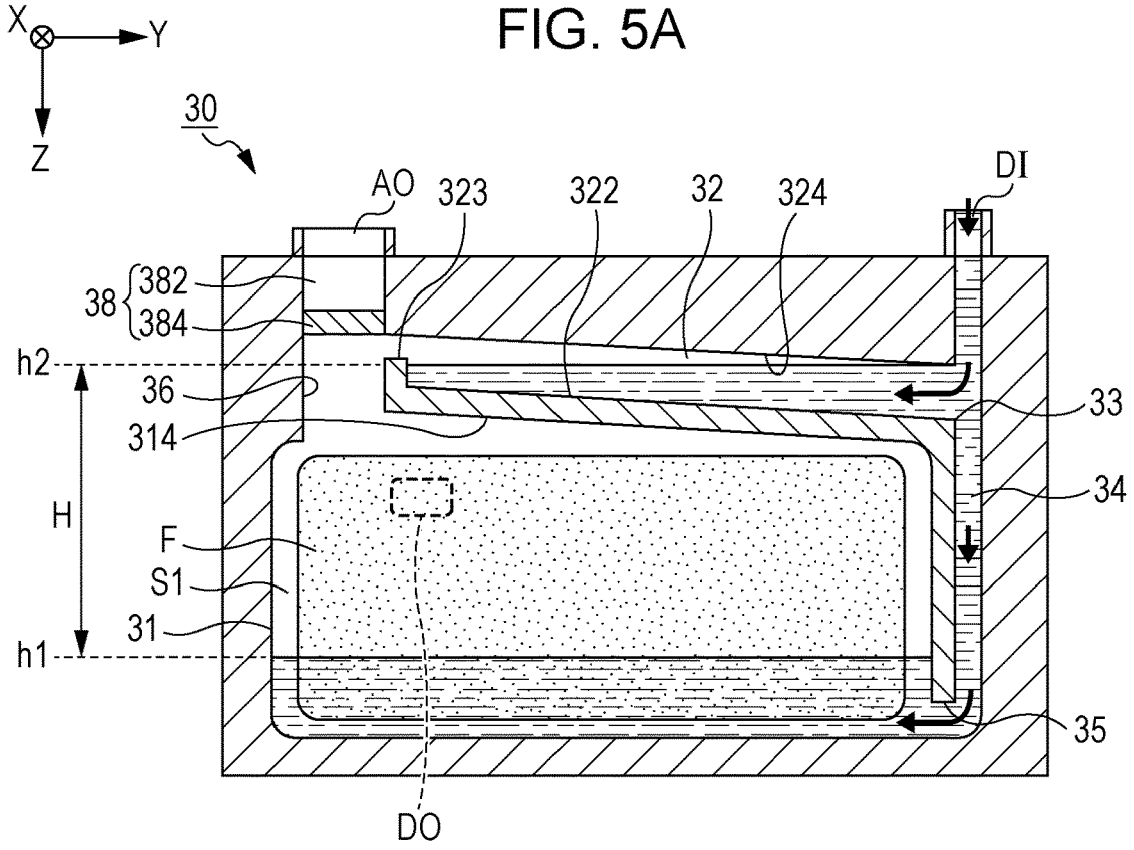
FIG. 5A is a cross-sectional view of a filter unit for explaining an operation during initial filling.
Figure 5B:
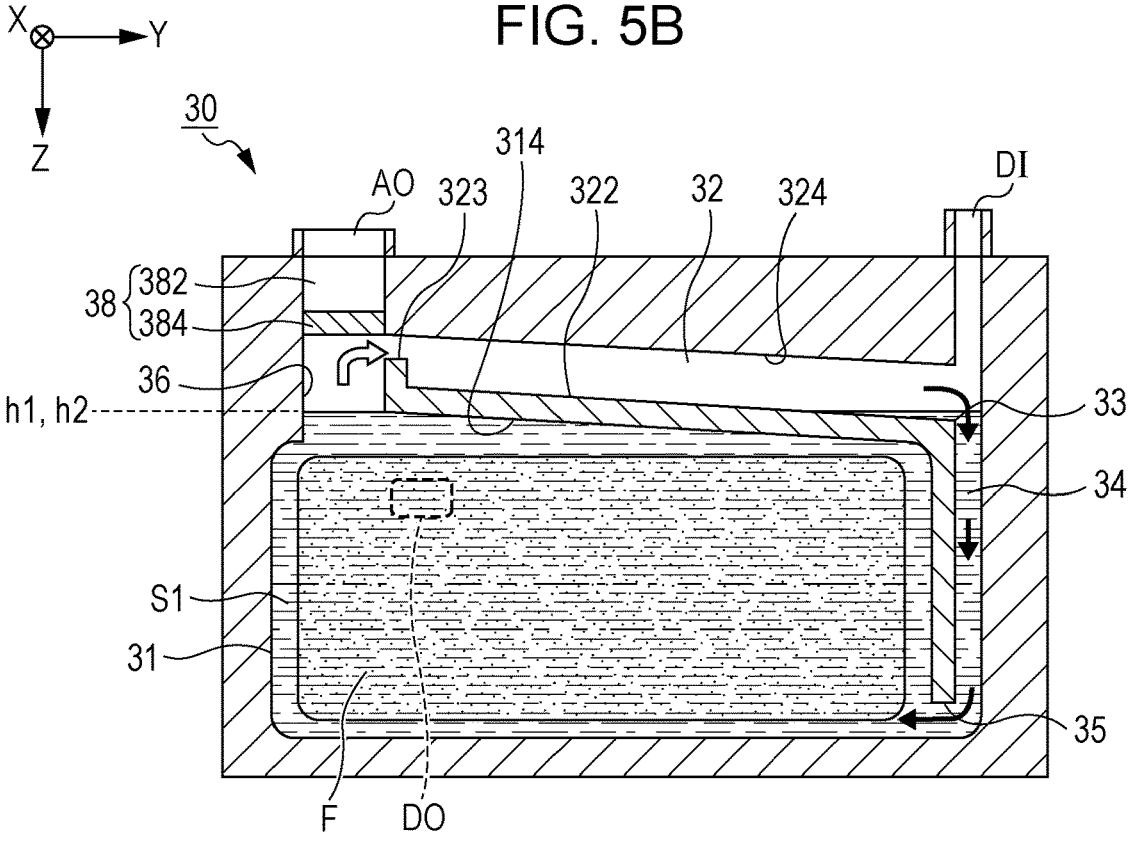
FIG. 5B is a cross-sectional view of the filter unit for explaining an operation following the operation of FIG. 5A.

FIGS. 5A and 5B are cross-sectional views of the filter unit 30 for explaining the operation during the ink initial filling. FIG. 5A is a diagram showing a case in which ink is supplied to the storage chamber 32 and the upstream side chamber S1 of the filter chamber 31 by driving the pump P. FIG. 5B is a diagram for explaining an operation following the operation of FIG. 5A. FIG. 5B shows a case in which the ink in the storage chamber 32 is supplied is supplied to the upstream side chamber S1 of the filter chamber 31 by stopping the pump P. The pump P is controlled by a plurality of steps performed by the control apparatus 12 during the ink initial filling. Specifically, the control apparatus 12 fills the filter chamber 31 with ink by controlling the pump P by the first and second steps below.

First, in the first step, the control apparatus 12 drives the pump P and supplies ink to the upstream side chamber S1 of the filter chamber 31 and the storage chamber 32 through the supply flow path 34 so as to generate a head difference H between a liquid level h1 of the ink in the upstream side chamber S1 of the filter chamber 31 and a liquid level h2 of the ink in the storage chamber 32. When the pump P is driven in the first step, the ink is supplied to the supply flow path 34 through the inflow port DI. Then, as shown by solid line arrows in FIG. 5A, the ink supplied to the supply flow path 34 is supplied to the upstream side chamber S1 of the filter chamber 31 and also supplied to the storage chamber 32 and stored. The storage chamber 32 of the embodiment is arranged vertically above the filter chamber 31, so that the head difference H occurs between the liquid level h1 of the ink supplied to the upstream side chamber S1 of the filter chamber 31 and the liquid level h2 of the ink supplied to the storage chamber 32.

Next, in the second step, the control apparatus 12 stops the pump P and causes the filter chamber 31 to be filled with the ink stored in the storage chamber 32 through the supply flow path 34 by the head difference H. When the ink supply by the pump P is stopped, as shown by solid line arrows in FIG. 5B, the ink stored in the storage chamber 32 is promptly flowed into the upstream side chamber S1 of the filter chamber 31 through the supply flow path 34 by the head difference H occurring in FIG. 5A. Then, as shown in FIG. 5B, when the liquid level h1 in the upstream side chamber S1 and the liquid level h2 in the storage chamber 32 become the same height and the head difference H disappears, ink filling is completed. As described above, according to the embodiment, it is possible to promptly fill the upstream side chamber S1 of the filter chamber 31 with ink by using the head difference H between the liquid level h1 of the ink in the upstream side chamber S1 of the filter chamber 31 and the liquid level h2 of the ink in the storage chamber 32, so that it is possible to improve the filling property of ink into the filter chamber 31.

In FIG. 5B, the gas (bubbles) in the filer chamber 31 is discharged to the storage chamber 32 through the second connection portion 36, so that the ink stored in the storage chamber 32 easily flows into the upstream side chamber S1 of the filter chamber 31 through the first connection portion 35. Specifically, when seen from the storage chamber 32, while the ink is discharged from the storage chamber 32 to the filter chamber 31 through the first connection portion 35 as shown by solid line arrows in FIG. 5B, the gas in the upstream side chamber S1 of the filter chamber 31 is introduced from the second connection portion 36 to the storage chamber 32 as shown by a white arrow. Therefore, the ink in the storage chamber 32 easily flows to the upstream side chamber S1 of the filter chamber 31, and the ink in the upstream side chamber S1 of the filter chamber 31 is easily discharged to the storage chamber 32. As described above, according to the embodiment, it is possible to improve the filling property of ink into the filter chamber 31 by only switching the pump P from the drive by the first step to the stop by the second step. Therefore, for example, even when the air in the upstream side chamber S1 of the filter chamber 31 is not sucked from the downstream side chamber S2 and accordingly is not discharged through the filter F, it is possible to improve the filling property of ink, so that it is possible to simplify the control performed by the control apparatus 12 to fill the filter chamber 31 with ink.

During Printing

Figure 6A:
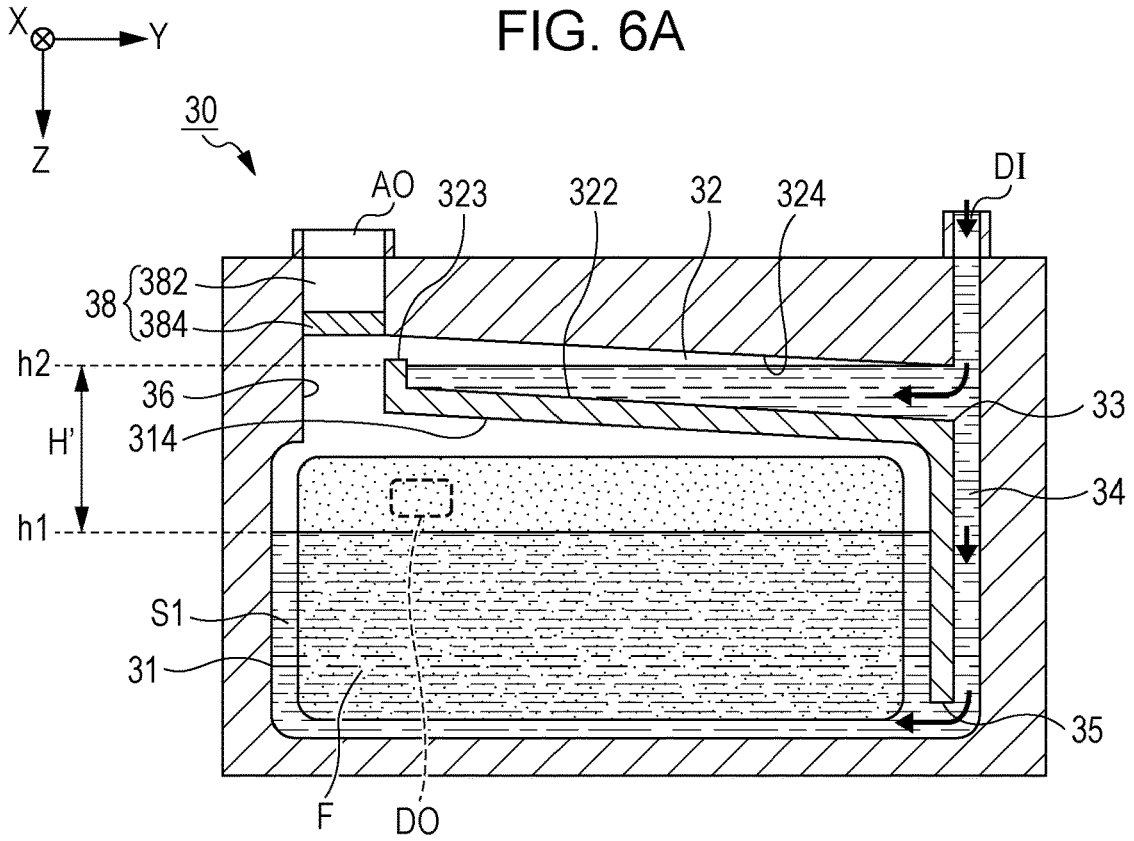
FIG. 6A is a cross-sectional view of the filter unit for explaining an operation during printing.
Figure 6B:
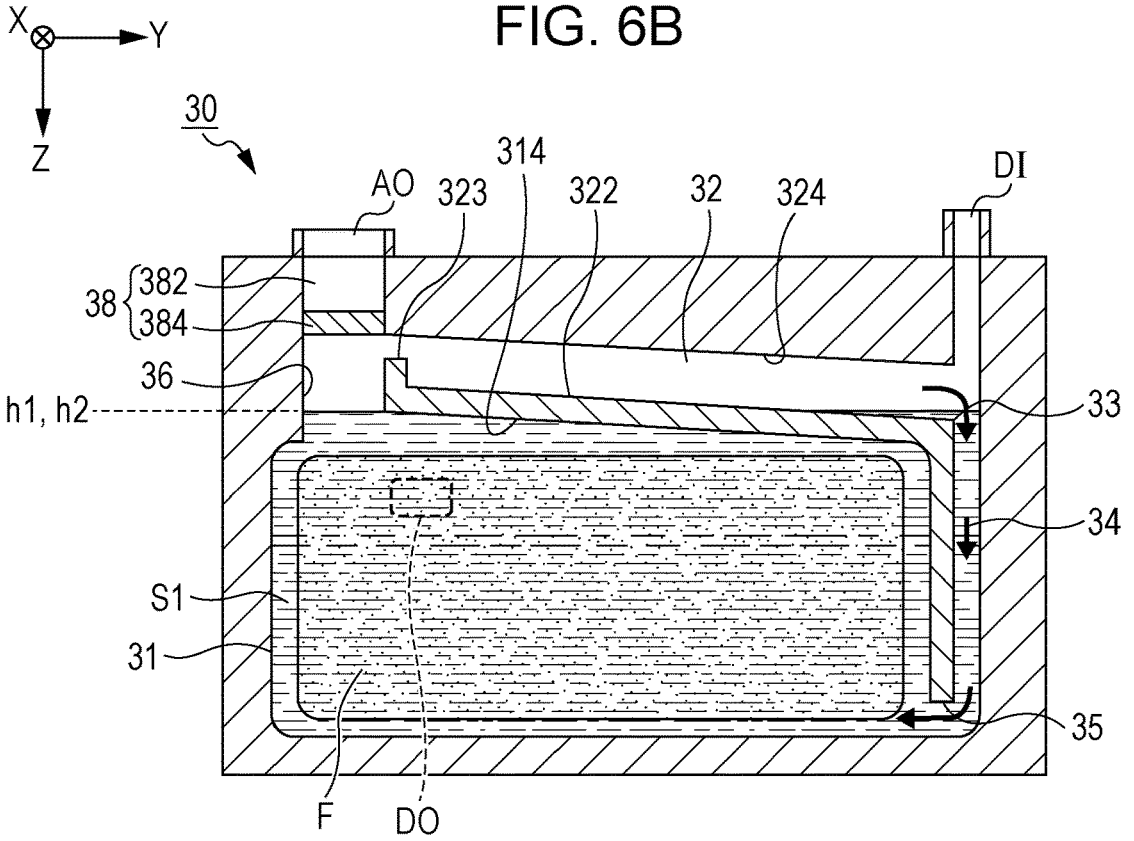
FIG. 6B is a cross-sectional view of the filter unit for explaining an operation following the operation of FIG. 6A.

FIGS. 6A and 6B are cross-sectional views of the filter unit 30 for explaining an operation during printing. FIG. 6A is a diagram showing a case in which the ink is consumed and the upstream side chamber S1 is depressurized, so that ink is supplied to the storage chamber 32 and the upstream side chamber S1 of the filter chamber 31. FIG. 6B is a diagram for explaining an operation following the operation of FIG. 6A. FIG. 6B shows a case in which the printing is completed and the supply of the ink is stopped, so that the ink in the storage chamber 32 is supplied to the upstream side chamber S1 of the filter chamber 31. During printing, the pump P is driven and ink is forcibly transferred. During printing after the ink initial filling is completed, even when ink is forcibly transferred by the pump P, if the ink is not consumed, for example, a pressure regulating valve (a self sealing valve) which is not shown in the drawings and which is provided on the upstream side of the filter unit 30 is closed, so that the ink is not supplied from the inflow port DI. When the ink is consumed by being discharged from the nozzles N and a predetermined pressure is obtained, the pressure regulating valve is opened, ink is supplied to the supply flow path 34 through the inflow port DI, and the ink is supplied to both the upstream side chamber S1 of the filter chamber 31 and the storage chamber 32 as shown by solid line arrows in FIG. 6A.

For example, when the printing is performed and the ink is consumed from a state of FIG. 5B, the ink in the upstream side chamber S1 of the filter chamber 31 passes through the filter F to move to the downstream side chamber S2 and is supplied to the liquid discharge unit 22 from the outflow port DO. Therefore, as shown in FIG. 6A, the liquid level h1 of the upstream side chamber S1 of the filter chamber 31 falls, so that a head difference H' occurs between the liquid level h1 in the upstream side chamber S1 and the liquid level h2 in the storage chamber 32. However, ink is supplied from the inflow port DI as shown by the solid line arrows in FIG. 6A, so that the head difference H' is reduced or maintained. The head difference H' during printing in FIG. 6A is smaller than the head difference H during the ink initial filling in FIG. 5A, so that the head difference H' is easily reduced or maintained by supplying ink from the inflow port DI.

As described above, immediately after the ink initial filling, the liquid level h1 of the upstream side chamber S1 falls due to a resistance (pressure loss) of the supply flow path 34 and the head difference H' easily occurs. However, the flow speed of the ink during the ink initial filling is faster than the flow speed of the ink when printing a solid pattern image where the amount of ink to be consumed at one time is maximum, so that it is possible to secure an effective area of the filter F. Here, the solid pattern image means an image where a dot is recorded on each of all pixels, each of which is a minimum recording unit area defined by a recording resolution.

When the printing is completed and the supply of the ink from the inflow port DI is stopped, the ink in the storage chamber 32 is supplied to the upstream side chamber S1 of the filter chamber 31 as shown by solid line arrows in FIG. 6B, so that the head difference H between the liquid level h1 in the upstream side chamber S1 and the liquid level h2 in the storage chamber 32 disappears. When the printing is started again and the ink is consumed, the head difference H' occurs as shown in FIG. 6A. However, ink is supplied from the inflow port DI as shown by the solid line arrows in FIG. 6A, so that the head difference H' is reduced or maintained.

During Defoaming

Figure 7A:
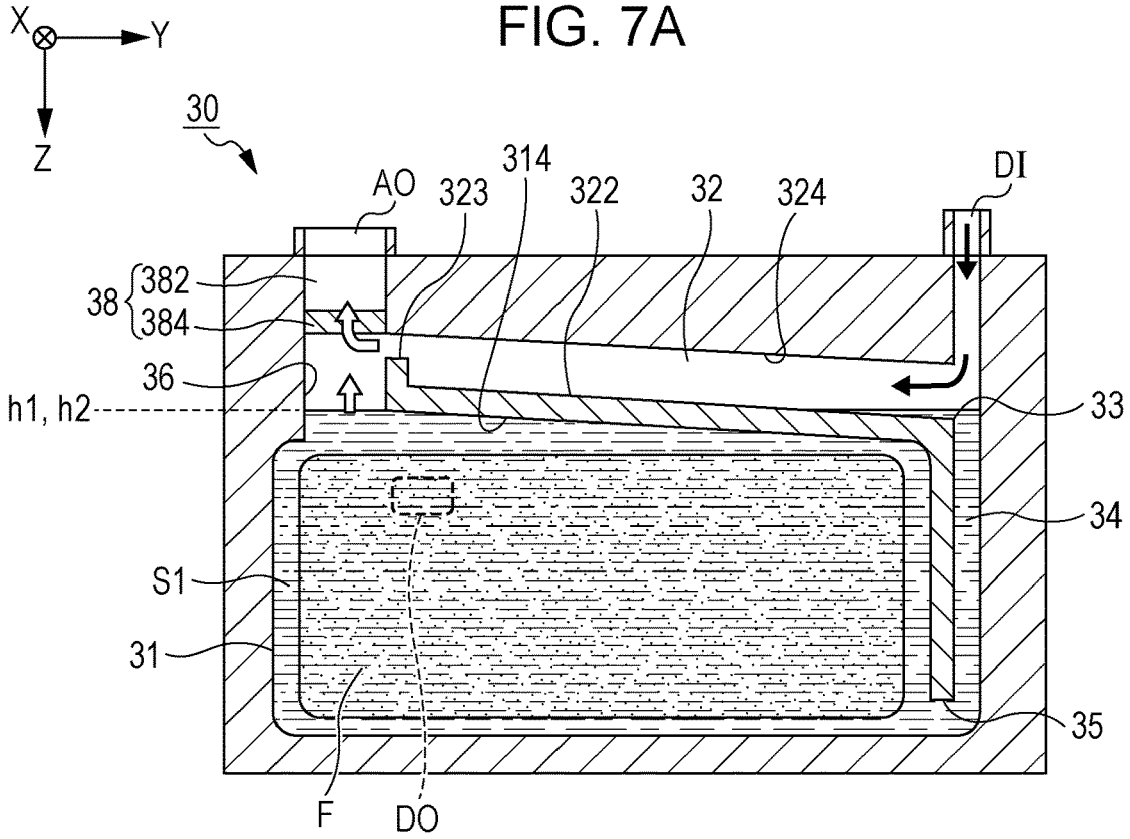
FIG. 7A is a cross-sectional view of the filter unit for explaining an operation during defoaming.
Figure 7B:
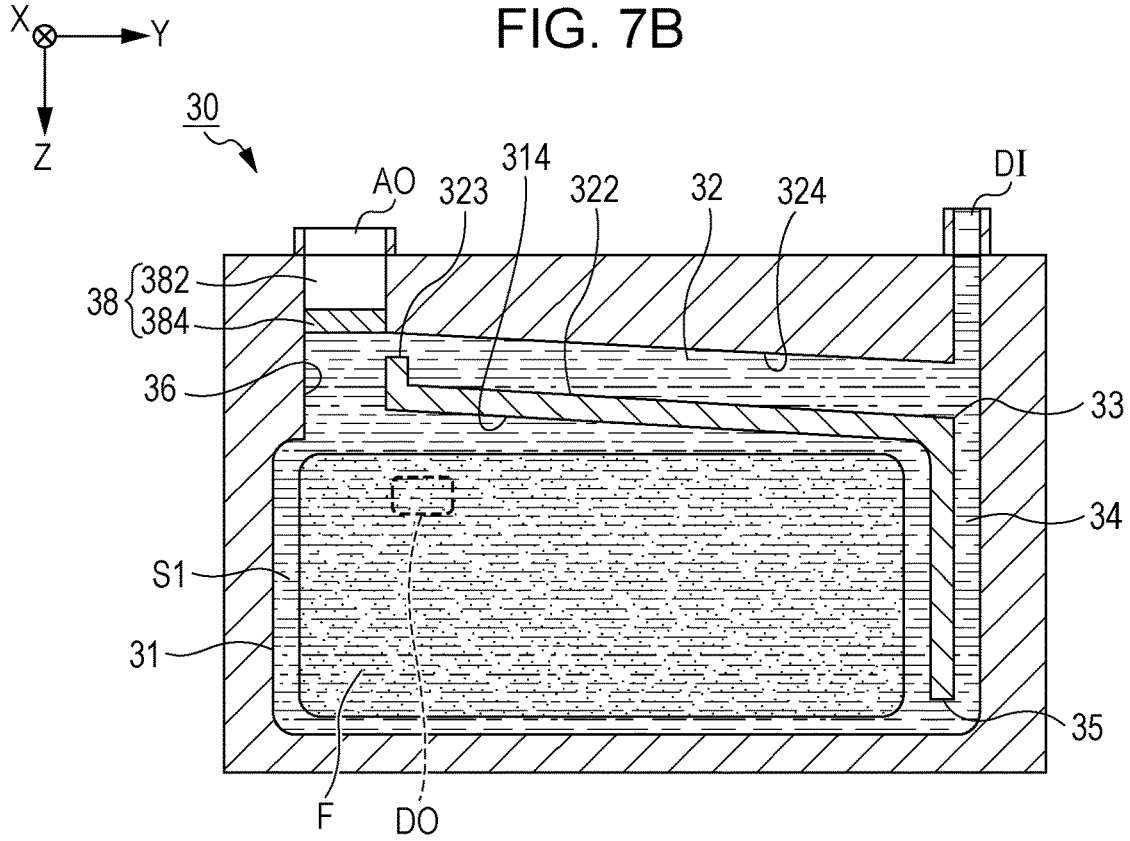
FIG. 7B is a cross-sectional view of the filter unit for explaining an operation following the operation of FIG. 7A.

FIGS. 7A and 7B are cross-sectional views of the filter unit 30 for explaining an operation during defoaming. FIG. 7A is a diagram showing a state when the defoaming is started. FIG. 7B is a diagram for explaining an operation following the operation of FIG. 7A. FIG. 7B is a diagram showing a state when the defoaming is completed. By the defoaming of the filter unit 30, the gas (bubbles) remaining in the storage chamber 32 and the upstream side chamber S1 of the filter chamber 31 is discharged from the gas discharge portion 38. The defoaming of the filter unit 30 is performed when the ink initial filling to the filter chamber 31 is completed. The defoaming operation may be performed during printing. The defoaming of the filter unit 30 may be performed regularly or may be performed by an operation of a user.

When the control apparatus 12 starts the defoaming by depressurizing the defoaming chamber 382 by using a depressurizing pump not shown in the drawings, as shown by white arrows in FIG. 7A, the gas remaining in the storage chamber 32 and the upstream side chamber S1 of the filter chamber 31 is discharged to the defoaming chamber 382 passing through the permeable membrane 384. At this time, as shown by solid line arrows in FIG. 7A, ink is supplied from the inflow port DI. When the defoaming is completed, as shown in FIG. 7B, the gas remaining in the storage chamber 32 and the upstream side chamber S1 of the filter chamber 31 is replaced with the ink, and it is possible to fill the storage chamber 32 and the upstream side chamber S1 of the filter chamber 31 with the ink.

Modified Example

The modes and the embodiment illustrated above can be variously modified. Specific modified modes will be illustrated below. Two or more modes arbitrarily selected from the illustrations below and the above modes can be appropriated merged to the extent that they do not contradict each other.

(1) In the embodiment described above, a serial head where the carriage 18 mounted with the liquid discharge head 20 is repeatedly reciprocated along the X direction is illustrated. However, the invention can be applied to a line head where the liquid discharge head 20 is arranged over the entire width of the medium 11.

(2) In the embodiment described above, the liquid discharge head 20 of a piezoelectric system using piezoelectric elements that apply mechanical vibration to the pressure chambers is illustrated. However, it is possible to employ a liquid discharge head of a thermal system using heat generating elements that generate bubbles in pressure chambers by heating.

(3) The liquid discharge apparatus 10 illustrated in the embodiment described above can be employed for various devices such as a facsimile apparatus and a copy machine in addition to devices dedicated to printing. Of course, use of the liquid discharge apparatus 10 of the invention is not limited to printing. For example, the liquid discharge apparatus 10 that discharges a solution of coloring material is used as a manufacturing apparatus that forms a color filter of a liquid crystal display apparatus. Further, the liquid discharge apparatus 10 that discharges a solution of conductive material is used as a manufacturing apparatus that forms wiring and electrodes of a wiring substrate.

The entire disclosure of Japanese Patent Application No. 2017-12716, filed Jan. 27, 2017 is expressly incorporated by reference herein.

What is claimed is:

1. A liquid discharge apparatus comprising:
- a liquid discharge unit
- a flow path for supplying liquid to the liquid discharge unit;
- a pump configured to supply the liquid to the flow path; and
- the flow path including:
  - a filter chamber divided into an upstream side chamber and a downstream side chamber by a filter, an outflow port being placed in the downstream side chamber;
  - a storage chamber that is arranged vertically above the filter chamber;
  - a supply flow path for supplying liquid to the filter chamber and the storage chamber;
  - a first connection portion connecting the supply flow path and the upstream side chamber directly, and the first connection portion is placed at a lower position than the outflow port; and
  - a second connection portion connecting the storage chamber and the upstream side chamber.

2. The liquid discharge apparatus according to claim 1, further comprising: a gas discharge portion that is provided in the storage chamber.

3. The liquid discharge apparatus according to claim 2, wherein
- a flow path resistance from the upstream side chamber of the filter chamber to the storage chamber through the second connection portion is greater than a flow path resistance from the upstream side chamber of the filter chamber to the storage chamber through the first connection portion.

4. The liquid discharge apparatus according to claim 3, wherein
- the gas discharge portion is provided in a ceiling surface of the storage chamber, and
- a portion where the gas discharge portion is provided in the ceiling surface of the storage chamber is located above a position, where the storage chamber is connected to the supply flow path, in a vertical direction.

5. The liquid discharge apparatus according to claim 1, wherein the second connection portion is provided in a ceiling surface of the upstream side chamber of the filter chamber, and the ceiling surface inclines upward in a vertical direction as the ceiling surface approaches the second connection portion.

6. The liquid discharge apparatus according to claim 1, wherein a flow path resistance from the supply flow path to the upstream side chamber of the filter chamber through the storage chamber and the second connection portion is smaller than a flow path resistance from the supply flow path to the upstream side chamber of the filter chamber through the first connection portion.

7. The liquid discharge apparatus according to claim 1, wherein a bottom surface of the storage chamber inclines downward in a vertical direction as the bottom surface approaches a position where the storage chamber is connected to the supply flow path.

8. The liquid discharge apparatus according to claim 1, wherein a volume of the storage chamber is greater than or equal to a volume of the upstream side chamber of the filter chamber.

9. The liquid discharge apparatus according to claim 1, wherein the pump is configured to be controlled by a plurality of steps, and the plurality of steps includes a first step of driving the pump and supplying the liquid to the upstream side chamber of the filter chamber and the storage chamber through the flow path so that a head difference occurs between a liquid level of the liquid in the upstream side chamber of the filter chamber and a liquid level of the liquid in the storage chamber, and a second step of stopping the pump and causing the upstream side chamber of the filter chamber to be filled with the liquid stored in the storage chamber through the flow path by the head difference.

10. A driving method of a liquid discharge apparatus, wherein the liquid discharge apparatus includes:

a liquid discharge unit;

a flow path for supplying liquid to the liquid discharge unit, a pump configured to supply the liquid to the flow path; and the flow path including:

a filter chamber divided into an upstream side chamber and a downstream side chamber by a filter, an outflow port being placed in the downstream side chamber, a storage chamber that is arranged vertically above the filter chamber, a supply flow path for supplying liquid to the filter chamber and the storage chamber, a first connection portion connecting the supply flow path and the upstream side chamber directly, and the first connection portion is placed at a lower position than the outflow port, and a second connection portion connecting the storage chamber and the upstream side chamber, and the driving method includes a first step of driving the pump and supplying the liquid to the upstream side chamber of the filter chamber and the storage chamber through the flow path so that a head difference occurs between a liquid level of the liquid in the upstream side chamber of the filter chamber and a liquid level of the liquid in the storage chamber, and a second step of stopping the pump and causing the upstream side chamber of the filter chamber to be filled with the liquid stored in the storage chamber through the flow path by the head difference.

11. The liquid discharge apparatus according to claim 1, wherein the second connection portion is provided in a ceiling surface of the upstream side chamber of the filter chamber, and the ceiling surface inclines upward in a vertical direction as the ceiling surface approaches the second connection portion.

12. The liquid discharge apparatus according to claim 11, wherein a flow path resistance from the supply flow path to the upstream side chamber of the filter chamber through the storage chamber and the second connection portion is smaller than a flow path resistance from the supply flow path to the upstream side chamber of the filter chamber through the first connection portion.

13. The liquid discharge apparatus according to claim 12, wherein a bottom surface of the storage chamber inclines downward in a vertical direction as the bottom surface approaches a position where the storage chamber is connected to the supply flow path.

14. The method according to claim 10, wherein a volume of the storage chamber is greater than or equal to a volume of the upstream side chamber of the filter chamber.

15. The liquid discharge apparatus according to claim 2, wherein the gas discharge portion discharges gas from the storage chamber, the gas discharge portion includes a gas permeable membrane structured to permit the gas to pass therethrough while at least partially preventing the liquid from passing therethrough.

16. The liquid discharge apparatus according to claim 1, wherein the storage chamber includes a gas discharge portion that discharges gas from the storage chamber, the gas discharge portion includes a gas permeable membrane structured to permit the gas to pass therethrough while at least partially preventing the liquid from passing therethrough, and wherein a depressurizing pump is provided in a particular flow path between the gas discharge portion and a waste liquid tank, the depressurizing pump applying a negative pressure to extract the gas from the storage chamber through the gas permeable membrane.

17. The liquid discharge apparatus according to claim 1, wherein the storage chamber comprises a vertical bank portion disposed overtop of the filter and the upstream side chamber, the vertical bank portion controlling a maximum liquid amount that is storable in the storage chamber prior to excess liquid overflowing into the upstream side chamber.

18. The liquid discharge apparatus according to claim 1, wherein the first connection portion is placed so the liquid flowing from the first connection portion can reach an area of vertically below the outflow port in the filter chamber without moving vertically.

19. The liquid discharge apparatus according to claim 10, wherein the first connection portion is placed so the liquid flowing from the first connection portion can reach an area of vertically below the outflow port in the filter chamber without moving vertically.

* * * * *